United States Patent [19]

Bell

[11] Patent Number: 4,810,217

[45] Date of Patent: Mar. 7, 1989

[54] PROPULSION DEVICE FOR SMALL BOATS

[76] Inventor: George F. Bell, 56 St. Patrick Street, Goderich, Ontario, Canada, N7A 2L4

[21] Appl. No.: 167,915

[22] Filed: Mar. 14, 1988

[30] Foreign Application Priority Data

Dec. 24, 1987 [CA] Canada ..... 555441

[51] Int. Cl.[4] ..... B63H 16/04

[52] U.S. Cl. ..... 440/13; 440/101; 416/70 R

[58] Field of Search ..... 440/13, 17, 19, 101, 440/32, 102; 416/64, 66, 70 R; 114/311

[56] References Cited

U.S. PATENT DOCUMENTS

| | | | |
|---|---|---|---|
| 678,193 | 9/1901 | Peterson | 440/101 |
| 1,197,239 | 9/1916 | Sinclair | 440/101 |
| 1,588,952 | 9/1925 | Dure | 440/13 |
| 2,534,180 | 12/1950 | Raicy | 440/19 |
| 2,628,586 | 2/1953 | Hoffman | 440/101 |
| 2,818,042 | 12/1957 | Manhart | 114/311 |
| 3,800,734 | 4/1974 | Whang | 440/13 |
| 4,578,038 | 3/1986 | Lenten | 440/19 |

*Primary Examiner*—Sherman D. Basinger
*Assistant Examiner*—Edwin L. Swinehart

[57] ABSTRACT

A propulsion device for small craft having a shaft, a flexible bag on the shaft at one end, the bag having a larger end which is open and a smaller end with a water flow opening, a cross member extending transversely of the shaft and across the larger bag end, and a spreader device to spread the bag.

10 Claims, 5 Drawing Sheets

PROPULSION DEVICE FOR SMALL BOATS

The invention relates to a propulsion device for small boats, and in particular to a manual propulsion device intended to replace conventional paddles.

BACKGROUND OF THE INVENTION

It is essential that small craft shall have some means of auxiliary propulsion other than the sails or motor with which they are equipped. The wind may die, rigging may fail, and motors are prone to malfunction. In addition, when manoeuvring such craft around a restricted anchorage, or in a canal, sails or power may be impractical as a means of propulsion.

Small boats are conventionally provided with auxiliary manual propulsion by means either of paddles or oars, the two terms being synonymous for the purposes of this description. Paddles and oars are satisfactory generally when used on small boats designed for paddling or rowing. Where paddles or oars are used as auxiliary propulsion devices on small sail boats or small power boats, they become impractical. The difficulties of attempting to paddle a sail boat, or small power boat, are too well known to require description.

In spite of these problems, there are now numerous regulations regarding the equipment and operation of such small craft. Normally such regulations specify that the craft must be equipped with "paddles". Penalties can be imposed on persons operating such craft without having "paddles" on board.

Various different means of manual propulsion devices have been proposed in the past, to replace or supplement paddles. Examples are shown in U.S. Pat. Nos. 678,193, 1,197,239, 2,534,180, 2,628,586, and 4,458,038. All of these devices have suffered from various mechanical design problems, such as would make it seriously doubtful whether they could ever operate in the manner intended.

None of them are "auxiliary" means of propulsion, and none are dismountable for storage. However, all of them suffer from a more fundamental defect, namely that none of them could qualify as "paddles" within boating regulations as currently in force. Small craft, both sail and power, are thus currently equipped with two or more paddles of conventional design, with a view to complying with boating regulations, whereas in fact such paddles are virtually useless for the purpose intended and still leave the craft with virtually no means of auxiliary propulsion to supplement the sail or motor with which it is equipped.

Clearly it is desirable to provide a more effective means of propulsion for small craft which effectively permits the operator to move the craft when the sail or motor is not in use, and which at the same time is readily portable, can be stowed away when not in use, and which complies with boating regulations, thereby rendering the carrying of conventional paddles unnecessary.

BRIEF SUMMARY OF THE INVENTION

With a view to overcoming the various problems noted above and achieving the general objective as described, the invention comprises a propulsion device for small craft having an elongated shaft, defining an operator end and a free end, a flexible bag member on said shaft at said free end, said bag member defining a larger bag end and a smaller bag end, and said larger bag end being arranged around said free end of said shaft, a cross member extending transversely of said shaft adjacent said larger bag end, connection means connecting said cross member with said larger bag end, and, spreader means engageable with bag member, whereby to spread the same.

More particularly, it is an objective of the invention to provide a propulsion device having the foregoing advantages wherein the cross member is dismountable from the said shaft, for storage.

More particularly, it is an objective of the invention to provide a propulsion device having the foregoing advantages wherein the bag member may also be used to provide a paddling action.

More particularly, it is an objective of the invention to provide a propulsion device having the foregoing advantages which further incorporates holding means on two opposed sides of said shaft, and extending through opposite sides of said bag, whereby to hold said bag in an extended position in at least one plane.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

FIG. 3 is a plan view of the device shown dismantled for storage;

DESCRIPTION OF A SPECIFIC EMBODIMENT

Figure 1:
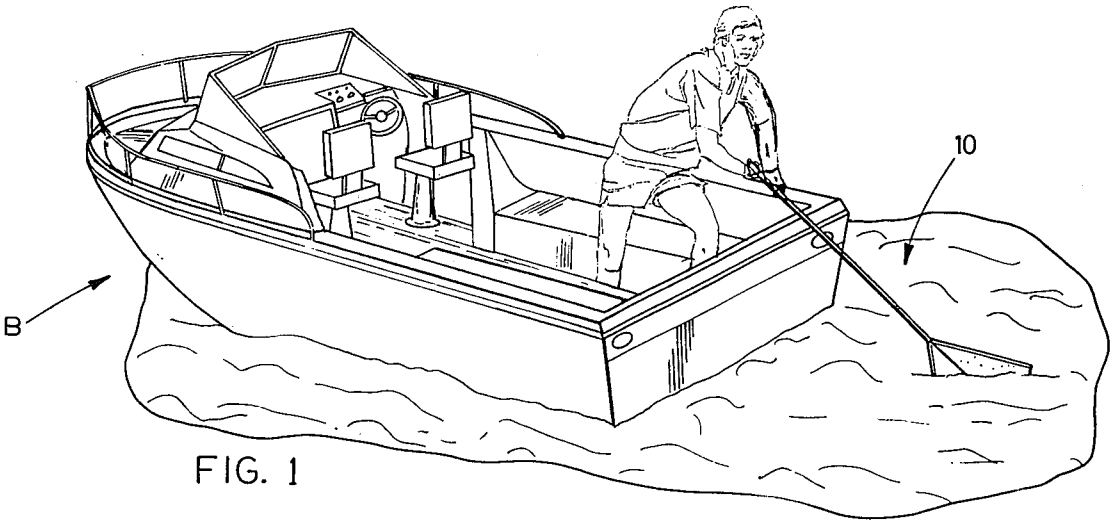
FIG. 1 is a perspective illustration of a small boat, showing the propulsion device according to the invention in use.
Figure 2:
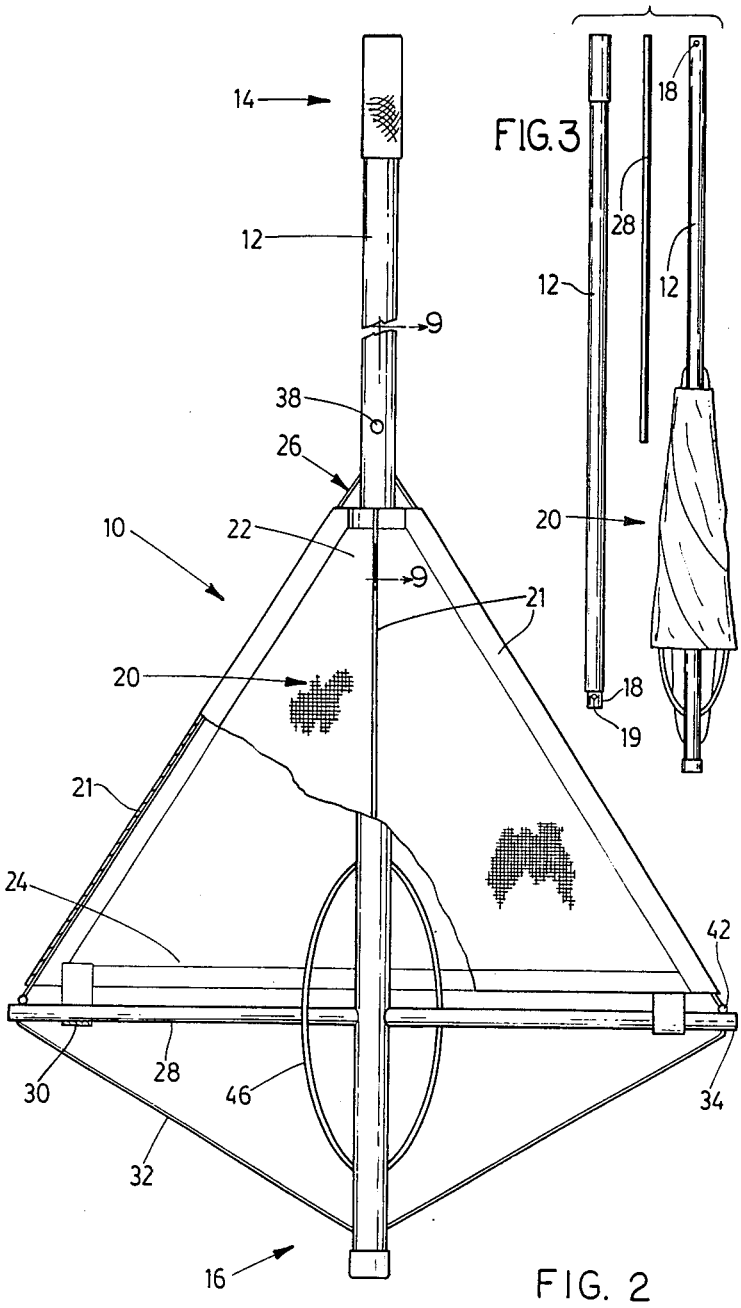
FIG. 2 is a plan view of the propulsion device, partly cut away.

Referring first of all to FIG. 1, it will be seen that this illustrates a small power boat, which may typically be anywhere from ten to twenty feet in length, in a typical case, although the invention is not to be restricted solely to boats of this size, or to power boats. It is equally applicable to smaller and larger boats, and to sail boats, without restriction.

Typically, boats of this size, when the engine or sail fails to provide propulsion, must be propelled manually. In view of the size of the boat, and its design it is virtually impossible to use oars. Similarly, if it is attempted to propel the boat by means of paddles, the design and construction of the boat usually renders it unsuitable for paddling.

In accordance with the invention, therefore, a propulsion device indicated generally as 10 is employed to provide a form of pushing action. The operator of the boat B simply sits or stands in the stern of the boat, and places the propulsion device 10 over the stern, and uses it by pushing against the water using an action somewhat similar to using a pole.

Referring now to FIGS. 2, 3, 4, and 5, the propulsion device 10 will be seen to comprise an elongated shaft 12 having a operator end 14, and a free end 16. The operator end 14 is simply equipped with any form of hand grip so that it may be gripped with one or both hands.

Figures 4, 5:
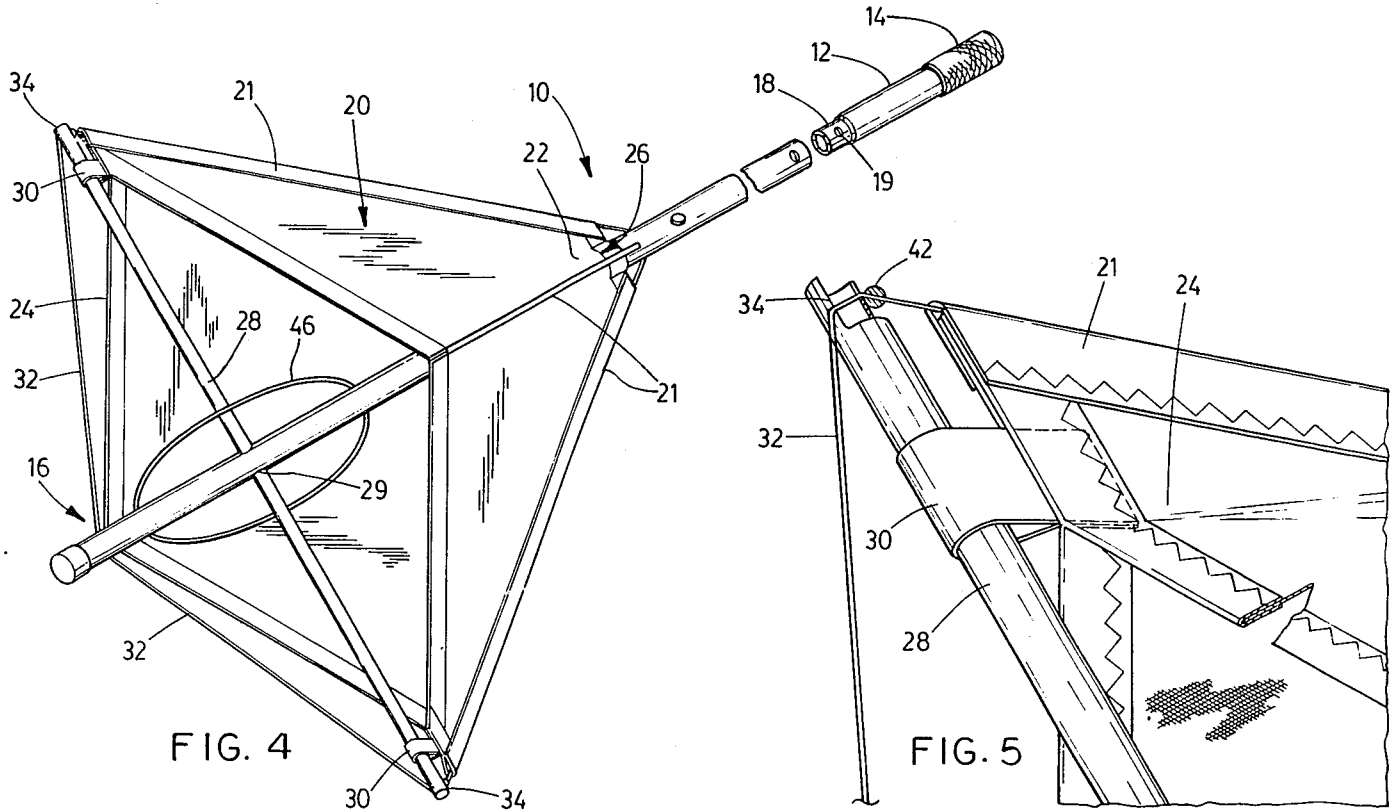
FIG. 4 is a perspective illustration of the device shown set up ready for use.
FIG. 5 is an enlarged perspective partly cut away, of detail of the device.
Figure 6:
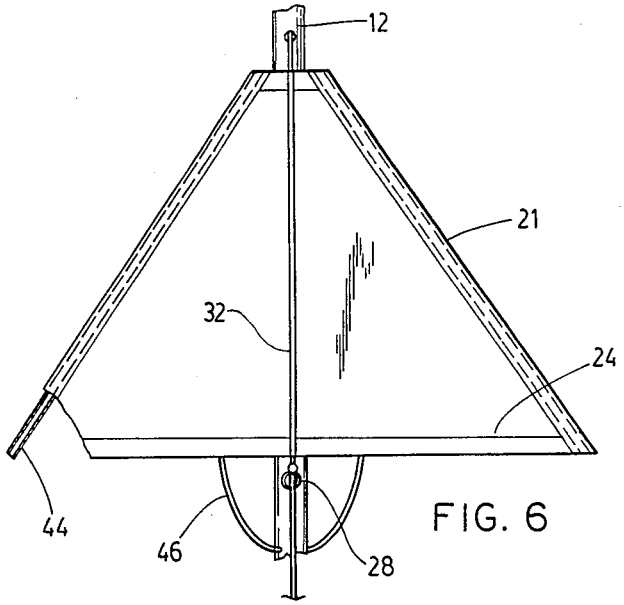
FIG. 6 is a plan view rotated 90 degrees with respect to FIG. 2.

For ease of storage the shaft 12 may be of two-part construction having a simple joint 18, and spring latch 19 (FIG. 4).

Near the free end 16, a bag member 20 is located. The bag member 20 is made of flexible material, typically being a strong form of fabric, such as sail cloth, or the like. The bag 20 is of generally pyramidical shape. Other shapes such as bell-shaped and frusto-conical shapes may also be suitable. In this example it is formed of four panels of fabric joined at seams 21. Bag member 20 defines a smaller end 22 and a larger end 24. Water flow opening means are provided in the bag to permit restricted flow of water through the bag. In this embodiment, the smaller end 22 defines a water flow opening 26 for purposes to be described below. The bag member 20 is positioned around the free end 16 with shaft 12 passing through opening 26. The larger end 24 of the bag member 20 is open. A cross bar or strut 28 is attached to the shaft near free end 16.

Strut 28 simply passes through holes 29 in shaft 12, and in this embodiment may be released and dismantled as described below.

The bag member is attached to the cross member or strut by means such as fabric loops 30 which are, in turn, secured to the wide or larger end 24 of the bag member.

In order to both hold the bag member open, and also to secure the cross member or strut in position, a pair of support members 32, in this case, formed of wire are attached to free end 16, and then are attached to opposite ends of the strut 28, and then passed down the inside of the bag member 20, on opposite sides and secured in shaft 12. Preferably, though not essentially, the two wires are sewn into two opposite side seams 21 of the bag member 20 to provide holding means. While reference is made to wire, it will be appreciated that other forms of support for the cross member, and holding means for the interior of the bag, may be provided, wire merely being convenient and readily available.

Preferably, although not essentially, it is desirable that the cross member or strut shall be dismountable for storage. In certain cases this may not always be necessary but, to most users the ability to store the propulsion device in a compact space will be a significant advantage.

Accordingly, in order to provide for this the wires are received in open ended notches 34 at the ends of the strut, so that the two wires can be released from the strut. In order to hold the two wires in tension, a tensioning device is provided in shaft 12, to which the ends of the wires are secured. Various different forms of tensioning device such as a threaded means, for example, a turn buckle (not shown) or the like, could be provided. However, in accordance with the invention, the tensioning device in this embodiment comprises a loop of elastic cord 36, one end of which is connected to a pin 38 secured in shaft 12. The two wires pass through openings 40 in the opposite sides of the shaft, and are connected to the loop 36 in any suitable manner as shown.

In the present embodiment of the invention two stop members 42 are secured on support wires 32, located so as to abut against strut 28 (FIG. 2) to resist stresses on the strut.

It will be seen that the two wires thus provide substantial support for the cross-member or strut while in use, and also function as holding means to hold the two opposite sides of the bag apart.

In the embodiment illustrated, the bag while being referred to as of generally pyramidical shape, for ease of construction is simply sewn together out of four panels of fabric. The shape of the bag, if it were held open, would thus be somewhat in the shape of a pyramid. However, other shapes may be suitable in some cases. In the pyramid form as illustrated, however, it will be noted that the two wires pass down opposite corners of the pyramid shape.

This leaves the other two corners of the pyramid free to flex in and out, and thus open and close.

To assist this action stiffening ribs 44 may be incorporated in the seams of the two free corners for purposes to be described.

In order to hold the bag partially open, a generally resilient spreader member 46 is preferably fastened on shaft 12 partially entering the open mouth at the large end of the bag.

In this way the opposite sides of the bag are held partially open.

In use, as stated above, the operator simply holds the shaft 12 and places the free end 16, with the bag 20 in the water, usually at the stern of the boat. He then simply pushes away from the boat somewhat in the manner of using a punt pole. Water will then flow into bag 20 and cause the sides of the bag to open up. The bag will thus engage a substantial volume of water, and due to the inertia of the water, sufficient energy can be applied to the boat to move it forwardly.

During the pushing action restricted water flow will take place through water flow opening 26 and smaller end 22. This assists in the pushing action and reduces the tendency of the device to twist or swing to one side.

The operator then simply draws the shaft 12 back towards the boar and again pushes.

Each time he draws the shaft towards the boat the bag will collapse and move freely through the water.

Each time he pushes away from the boat the bag will open up, engage a volume of water, and enable the operator to push. In fact, it has been found by experiment that a single operator can propel a power boat in excess of twenty feet in length with little difficulty. By pushing to one side or the other, the direction of movement can also be to a large degree controlled.

The device can also act as a rudder, by simply holding it over the stern in the water, with the bag on edge.

When the device is not in use, the wires can be pulled out of the slots at the end of the cross member. The cross member can then simply be withdrawn from the shaft 12, the shaft can be dismantled, and the bag will be collapsed, and can simply be wrapped around the shaft portions and cross member and stored in a compact space.

Figure 7:
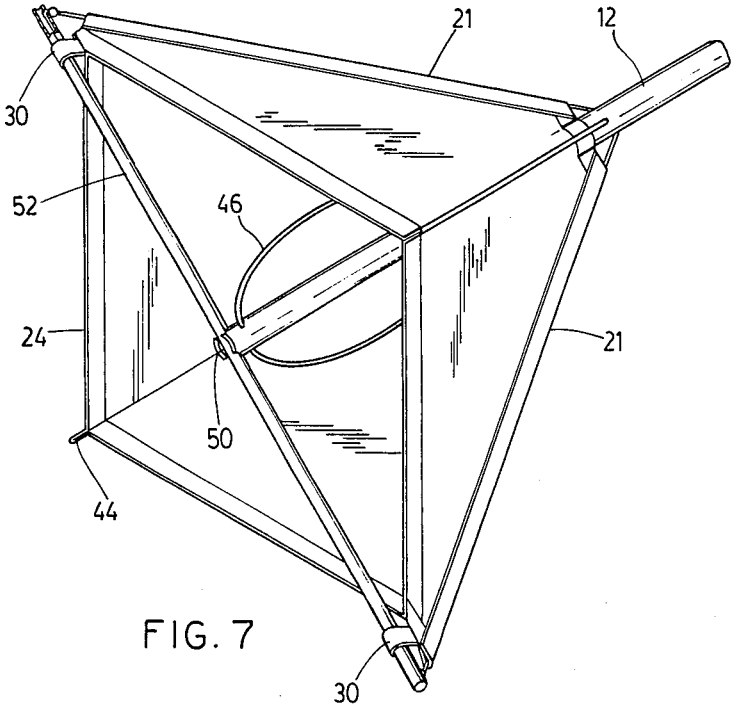
FIG. 7 is a perspective illustration of an alternate embodiment.
Figure 8:
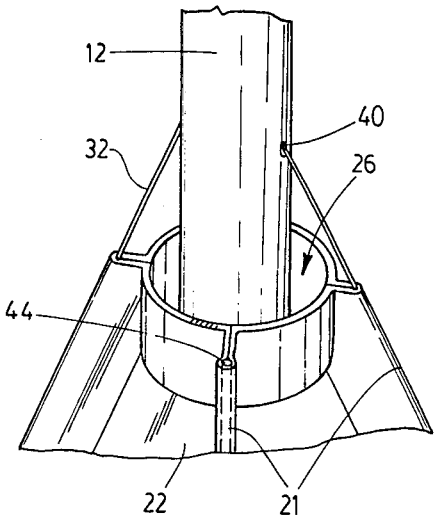
FIG. 8 is an enlarged perspective of a detail of the small end of the bag.

In accordance with a further embodiment of the invention, as illustrated in FIG. 7, a notch or recess 50 can be formed at the extreme end of shaft 12. In this case the cross-member or strut 52 is a hollow tube, and the wire passes directly along the interior of the strut. The other details of the alternate embodiment would be substantially as described in relation to FIGS. 1 to 4.

This would make the device somewhat easier to dismount and store in certain circumstances.

Figure 10:
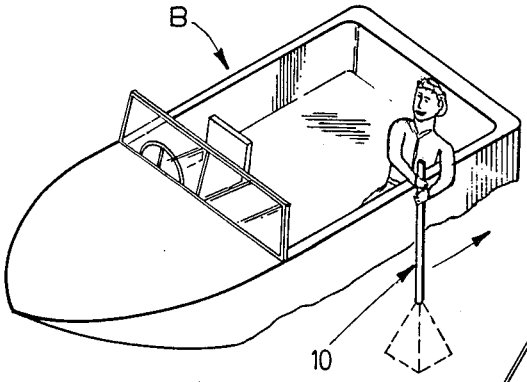
FIG. 10 is a perspective of a boat showing the device used for a paddling action.
Figure 9:
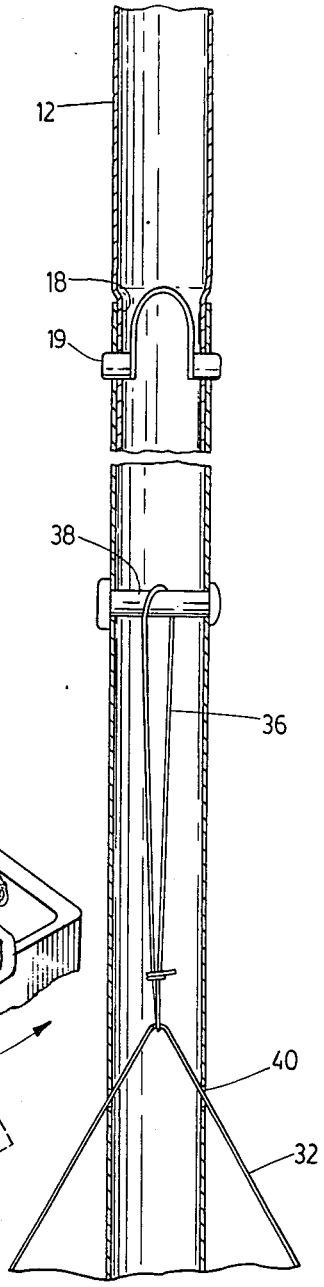
FIG. 9 is a section along 9—9 of FIG. 2.

The device can also be used with a paddling action, as shown in FIG. 10. In this case the shaft must be held so that the cross member is transverse to the direction in which the device is drawn through the water. The bag then remains essentially flat, and simply acts as a paddle blade.

The device therefore satisfies boating regulations since it can, if desired, be used as a paddle.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A propulsion device for small craft and comprising:

an elongated shaft defining an operator rearward end and a free forward end;

a flexible bag member mounted on said shaft near said free end, said bag member defining an open larger forward bag end and a smaller rearward bag end, and said larger bag end extending around said shaft, and said bag member defining water flow opening means at said rearward bag end;

a cross member extending transversely of said shaft adjacent said larger bag end;

connection means connecting said cross member with said larger bag end, and, spreader means engageable with said bag member, whereby to spread the same.

2. A propulsion device as claimed in claim 1 wherein said cross member is dismountable from said shaft for storage.

3. A propulsion device as claimed in claim 1 which further incorporates holding means secured to opposite ends of said cross member, and extending through opposite sides of said bag member, whereby to hold said bag member in an extended position in at least one plane.

4. A propulsion device as claimed in claim 1 including support means for supporting said cross member.

5. A propulsion device as claimed in claim 1 wherein said flexible bag member is of generally pyramidical shape, and defines at least four corners, and including stiffening means in a first said corner, and further stiffening means in a second said corner, said first and second corners being located on opposite sides of said bag.

6. A propulsion device as claimed in claim 5 including holding means extending from said shaft, along third and fourth corners of said bag to opposite ends of said cross member.

7. A propulsion device as claimed in claim 6 in which said shaft extends forwardly of said larger forward bag end, and which also comprises support means for said cross member extending from the ends of said cross member to the free forward end of said shaft.

8. A propulsion device as claimed in claim 7 including tensioning means within said shaft, said holding means being interengageable therewith.

9. A propulsion device as claimed in claim 5 including an open ended notch in the free end of said shaft, said cross member being received in said open ended notch, and being releasable therefrom.

10. A propulsion device as claimed in claim 1, wherein said spreader means comprises at least one generally flexible resilient spreader element, mounted on said shaft and located within said bag member.

* * * * *